US006208226B1

(12) United States Patent
Chen et al.

(10) Patent No.: US 6,208,226 B1
(45) Date of Patent: Mar. 27, 2001

(54) PLANAR COMB(-)LINE FILTERS WITH MINIMUM ADJACENT CAPACITIVE(-) COUPLING EFFECT

(75) Inventors: Kouth Chen; Ching-Kuang C. Tzuang, both of Hsinchu (TW)

(73) Assignee: Industrial Technology Research Institute, Hsinchu Hsien (TW); .

( * ) Notice: Subject to any disclaimer, the term of this patent is extended or adjusted under 35 U.S.C. 154(b) by 0 days.

(21) Appl. No.: 09/354,201

(22) Filed: Jul. 14, 1999

Related U.S. Application Data

(63) Continuation-in-part of application No. 08/965,662, filed on Nov. 6, 1997.

(51) Int. Cl.[7] ..... H01P 1/20
(52) U.S. Cl. ..... 333/202; 333/238
(58) Field of Search ..... 333/202–205, 333/238

(56) References Cited

U.S. PATENT DOCUMENTS 5,497,130 * 3/1996 Hirai et al. ..... 333/204

* cited by examiner

*Primary Examiner*—Robert Pascal
*Assistant Examiner*—Kimberly E Glenn
(74) *Attorney, Agent, or Firm*—W. Wayne Liauh

(57) ABSTRACT

A comb-line filter is disclosed which includes: (a) a top metal plate and a bottom metal plate; (b) a pair of resonators sandwiched between the top and bottom metal plates and in a parallel and spaced relationship with respect to the top and bottom metal plates; (c) a pair of resonator extensions extending from the pair of resonators, respectively, and (d) a pair of capacitor plates provided above and below the pair of resonators, respectively. The pair of capacitor plates and the pair of resonators extensions are grounded so as to provide a double-parallel capacitor groups. The comb-line filter can be constructed such that the ratio of the separation between the two resonators (d2) and the separation between the resonator and the capacitor plate (d1) is above about 3. By doing so, the coupling capacitance can be reduced to 0.1 pF or lower. In a more preferred embodiment, the ratio of d1/d2 is maintained to below 10, and the coupling capacitance will be essentially zero (less than 0.01 pF).

9 Claims, 7 Drawing Sheets

PLANAR COMB(-)LINE FILTERS WITH MINIMUM ADJACENT CAPACITIVE(-) COUPLING EFFECT

This is a continuation-in-part application of app. Ser. No. 08/965,662, filed Nov. 6, 1997.

FIELD OF THE INVENTION

The present invention relates to comb-line filters with minimum adjacent capacitive coupling effects. More specifically, the present invention relates to miniaturized planar-type comb-line filters with substantially reduced passband bandwidth and transmission loss, by minimizing the capacitive coupling effect between the two adjacent capacitors that are respectively connected to the two comb-line resonators in a comb-line filter, while allowing the dimensions of the comb-line filter to be substantially reduced, to the millimeters range.

BACKGROUND OF THE INVENTION

Conventional comb-line filters comprise cylindrical or rectangular metal pieces, which form at least a pair of resonators. Each of the resonators is respectively connected to a capacitor, which can be adjusted, for example, with a screw. The conventional comb-line filters suffer from the disadvantages of being relatively bulky in their physical dimension and are difficult to be mass-produced.

Relatively recently, planar type comb-line filters have been developed which are substantially smaller in dimension and can be mass-produced relatively easily. The planar comb-line filters are made by coating relatively thick films of an appropriate material on a substrate. However, it was found that, because of the substantially reduced distance between the pair of capacitors respectively connected to the resonators, significant "adjacent capacitive-coupling" effect has been observed which has become a major deterring factor of the planar comb-line filters. The adjacent capacitive-coupling effect can increase the passband bandwidth of the filter and adversely affect the transmission characteristics of the filters, thus causing the filters to be unable to meet the design requirement. In order to reduce such an undesirable effect, planar comb-line filters are typically designed to have resonators whose electrical length is greater than 50° (i.e., 50/360 of the wavelength at which the filter is designed to operate). By increasing the electrical length of the resonators, the required capacitance of the capacitors can be decreased accordingly, thus reducing the adjacent capacitive-coupling effect. However, increasing the length of the resonator, which necessitates the increase in the overall dimension of the planar comb-line filters, may be defeating the very purpose of developing the compact-sized planar comb-line filters.

If the length of the resonators is not increased, the adjacent capacitive-coupling effect becomes appreciable. FIGS. 1*a*–1*c* show schematic top views of the various layers, the top layer, the first layer, and the bottom layer, respectively, of a typical planar comb-line filter. Both the top layer and the bottom layer are grounded metal plates which are separated by a distance of about 1 mm. The first layer (i.e., the first layer immediately below the top layer) consists of two resonators. Each resonator has a small protruded portion for serving as input or output. In FIG. 1*b*, the right-handed side of the resonator is grounded while its left-handed side is connected to a capacitor.

FIG. 2 is a plot of transmission coefficient, $S_{21}$ (dB) vs. frequency, F (GHz) for a planar comb-line filter under ideal conditions. The simulation was done using an industrial standard full wave electromagnetic field simulation program under the hypothetical condition of a pair of ideal capacitors with zero adjacent capacitive-coupling. Each capacitor has a capacity of 22.6 pF. The length of the resonators in the ideal planar comb-line filter has been reduced to 26.5° electrical length, and the passband has a central frequency of 947.5 MHz (or 0.9475 GHz).

However, the results can become quite different if the assumption of ideal condition is breached. FIGS. 3 and 4 are simulated plots of transmission coefficient, $S_{21}$ (dB) vs. frequency, F (GHz) for two real life planar comb-line filters. Both planar comb-line filters have a pair of capacitors with the same capacity of 22.6 pF, however, they are arranged differently. As shown in FIGS. 3 and 4, both cases show a very significant bifurcation of the response curve. They also show increased bandwidth of the passband. The coupling capacities between the adjacent capacitors in FIGS. 3 and 4 are determined to be 5.5 pF and 2.4 pF, respectively. The comb-line filters as shown in FIGS. 3 and 4 also exhibit relatively high insertion loss at passband, and relatively low attenuation at stopband. Both are undesirable filter characteristics which are results of reduced filter dimension.

The above described problem was also discussed in U.S. Pat. No. 5,311,159 (the '159 patent). In order to provide miniaturized bandpass type filter which can be used in a frequency band more than about 1.5 GHz, the '159 patent devised a tri-plate line which is constructed from a resonance element formed by intervening dielectrics between one pair of ground conductors. The length of the line is adjusted to about ¼ wave-length (or 90° electric length). Then a plurality of resonators are combined to form a bandpass filter. While the '159 invention may have ameliorated the coupling problem of the resonators, it is relatively complex in design and would substantially increase the cost of making bandpass filters.

U.S. Pat. No. 4,963,843 disclosed a comb-line stripline filter which includes a number of conductive strips, each being connected to ground on one end and capatively loaded to ground at the other end. While the '843 invention solved some of the capacitive coupling problems, the results are not totally satisfactory; the electrical length of the resonators is generally set to about 75°. Thus the '843 invention could not provide the desired miniaturization for today's portable communication needs.

At the present time, there are no comb-line filters which are compact in size, can be manufactured relatively easily and inexpensively, and provide desired frequency response.

SUMMARY OF THE INVENTION

The primary object of the present invention is to develop planar comb-line filters which can be compact in size while eliminating or at least minimizing many of the shortcomings that have been encountered in the prior art comb-line filters, particularly those that are associated with the adjacent capacitive-coupling effect when attempts were made to reduce the dimension of the planar comb-line filters. The novel features of the present invention are most advantageous for use in manufacturing planar comb-line filters with dimensions in the millimeters range.

More specifically, the primary object of the present invention is to develop improved planar comb-line filters which meet the demand of minimum size, both in length and in the areal extent, while, at the same time, they are relatively free of the adverse effect of coupled capacitance that has been experienced in the prior art devices associated with the miniaturization of the filters. The improved planar comb-line filters can utilize resonators whose lengths are reduced to about 1/18 to 1/12 of the wavelength (i.e., within 20° to 30° electrical length), and the overall area of the filters can be reduced to about half of that of conventional comb-line filters, while retaining excellent filter characteristics.

After extensive research and development efforts, the co-inventors of the present invention discovered that the main reason for the large coupling capacitance experienced in the conventional miniaturized comb-line filters is that, when the dimension of the comb-line filters is reduced, essentially everything was scaled down proportionally. The co-inventors of the present invention further discovered that, by maintaining the ratio between the separation between the two resonators (d2) and the separation between the resonator and the capacitor plate (d1) above about 3, the coupling capacitance can be reduced to 0.1 pF or lower. In a more preferred embodiment, the ratio of d1/d2 is maintained to below 10, and the coupling capacitance will be essentially zero (less than 0.01 pF).

The improved comb-line filters exhibit extremely low insertion loss at passband, and extremely high attenuation at stopband, at a substantially reduced physical dimension. The small dimension, and consequently lighter weight, of the planar comb-line filters of the present invention makes them easier to be manufactured; it also makes the planar comb-line filters of the present invention ideal candidates for use in portable wireless communications.

The present invention discloses a multi-layered novel capacitor design to minimize the adjacent capacitive-coupling effect of a planar comb-line filter, while allowing the dimension, including the length, thereof to be substantially reduced. The capacitor design disclosed in the present invention contains a pair of capacitor groups arranged in parallel, each of the capacitor group contains a pair of capacitors, also connected in parallel. The double-layer-structured and parallel-arranged capacitor design allows the filter dimension to be reduced while avoiding the capacitive-coupling effect.

In the first embodiment of the present invention, the comb-line filter contains a pair of planar resonators sandwiched between two metal plates. All the layers in the comb-line filter are in spaced apart relationship. The resonators, which are identical and are symmetrically arranged, are shorter than the metal plates. The balance in length is occupied with a first capacitor plate, which is slightly wider than the resonator plate from one side of the resonator plate. Length-wise, the first capacitor plates are extensions of the resonator plates, but width-wise, they protrude from the pair of resonator plates in a mirrored manner relative to the center line separating the resonator plates. The comb-line filter of the present invention also contains a second and third capacitor plates sandwiched between the pair of resonator plates and the top layer, and between the resonator plates and the bottom metal plate, respectively. The second and third capacitor plates have a width substantially the same as that of the top and bottom metal plates, and a length substantially the same as the first capacitor plate. The first, second, and third capacitor plates form a pair of capacitor groups that are arranged in parallel, and each of the capacitor groups contains a pair of capacitors also connected in parallel.

The second embodiment of the present invention is a modification of the first embodiment. In the second embodiment, the first capacitor plates, which are extensions of the resonator plates, are folded up vertically and penetrate through the top metal plate, without contact. The second capacitor plate is similarly placed above the first capacitor plates, also in a spaced apart relationship, and the third capacitor plate is eliminated. The second capacitor plate and the one of the first capacitor plates form a capacitor, which is connected in parallel with the capacitor formed by the first capacitor plate and the top metal plate. This parallelly connected capacitor group is further in a parallel relationship with an identical capacitor group containing the other first capacitor plate. With the second embodiment, the entire comb-line filter can be made to have the same length as the resonator plates.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

The present invention discloses a multi-layered capacitor design to minimize the adjacent capacitive-coupling effect of a planar comb-line filter while allowing the filter dimension to be substantially reduced. The capacitor design disclosed in the present invention contains a pair of capacitor groups arranged in parallel, each of the capacitor group contains a pair of capacitors also connected in parallel. The double-layer-structured and double-parellelly-arranged capacitor design allows the filter dimension to be reduced while avioding the capacitive-coupling effect.

The wavelength of an electromagnetic wave, $\lambda$ in a relatively dielectric material can be determined by the following equation:

$$\lambda = \frac{c}{f\sqrt{\epsilon_r}}$$

where c is the speed of light, f is the frequency of the electromagnetic wave, and $\epsilon_r$ is the dielectric constant. With the improved design of the present invention, the planar comb-line filters can utilize resonators whose lengths are reduced to about 1/18 to 1/12 of the wavelength (i.e., within 20° to 30° electrical length), and the overall area of the filters can be reduced to about half of that of conventional comb-line filters, while retaining excellent filter characteristics. The resultant comb-line filters exhibit extremely low insertion loss at passband, and extremely high attenuation at stopband, at a substantially reduced dimension. The small dimension, and consequently lighter weight, of the planar comb-line filters of the present invention makes them easier to be manufactured; it also makes the planar comb-line filters of the present invention ideal candidates for use in wireless communications.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

Figure 5A:
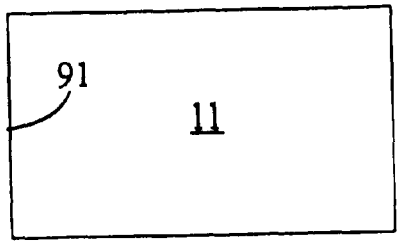
FIGS. 5*a–e* show the schematic top view of the top layer (top metal plate), first layer (second capacitor plate), second layer (resonators integrated with input/output terminal portions and the first capacitor plates), third layer (third capacitor plate), and bottom layer (bottom metal plate), respectively, of the comb-line filter according to the first embodiment of the present invention.
Figure 5B:
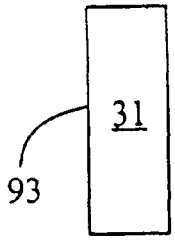
Figure 5C:
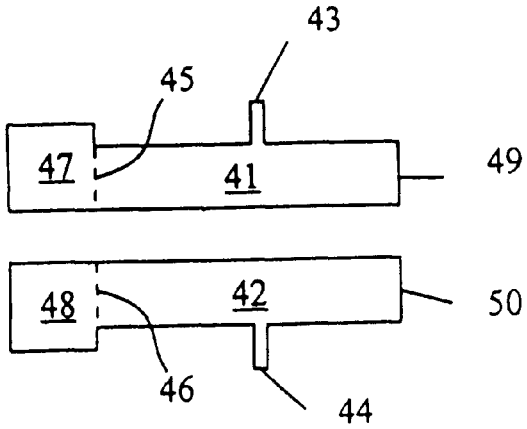
Figure 5D:
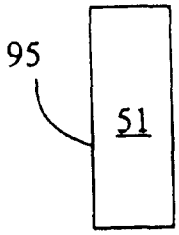
Figure 5E:
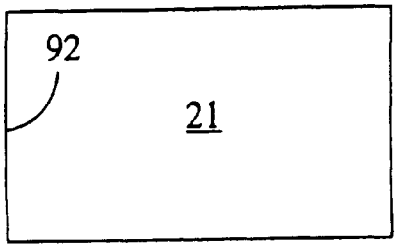
Figure 5F:
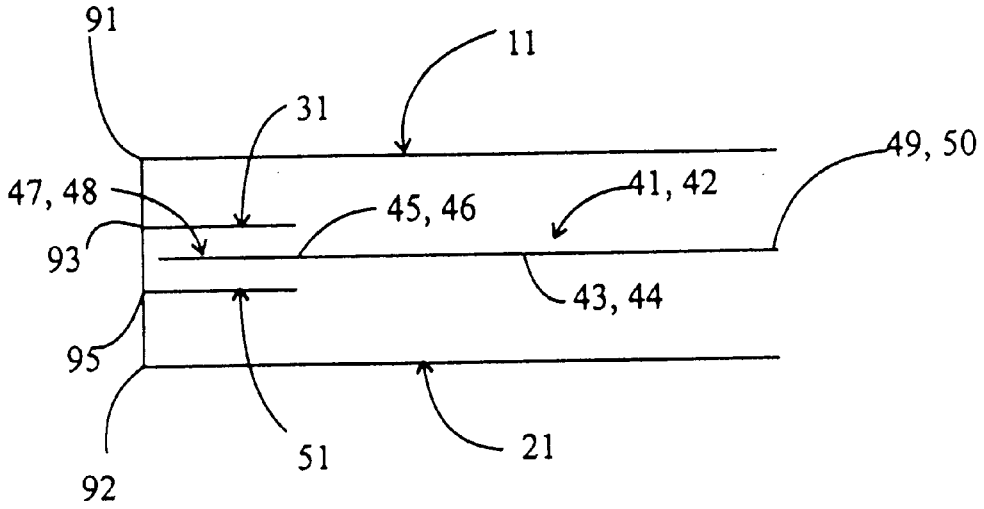
FIG. 5*f* is a schematic longitudinal cross-sectional view of the comb-line filter of the first embodiment of the present invention.

FIGS. 5*a–e* show the schematic top view of the top layer (top metal plate), first layer (second capacitor plate), second layer (resonators with first capacitor plates as respective extensions), third layer (third capacitor plate), and bottom layer (bottom metal plate), respectively, of the comb-line filter according to the first embodiment of the present invention. And FIG. 5*f* is a schematic longitudinal cross-sectional view of the comb-line filter. The comb-line filter contains a pair of planar resonators 41, 42 (to the right of the dotted lines 45, 46, respectively) sandwiched between two metal plates 11, 12. All the layers in the comb-line filter are in spaced apart relationships. The resonators 41, 42, which are identical and are symmetrically arranged, are shorter than the metal plates 11, 12. The balance in length is occupied with a first capacitor plate 47 or 48, which is slightly wider than the resonator plate and extends from one side of the resonator plate. Length-wise, the first capacitor plates are extensions of the resonator plates, but width-wise, they protrude from the pair of resonator plates in a mirrored manner relative to the center line separating the resonator plates. The left-hand sides 91, 92, of the metal plates 11, 12, respectively, are grounded. The right-hand sides 49, 50 of the resonators 41, 42 are also grounded. Two small protrusions 43, 44 are provided in the resonators 41 and 42 to serve as input and output ports (or terminal portions), respectively.

In the present invention, the comb-line filter of also contains a second and third capacitor plates 31, 51, sandwiched between the pair of capacitor plates 47, 48, and the top layer 11, and between the capacitor plates 47, 48 and the bottom metal plate 21, respectively. The second and third capacitor plates 31, 51 are grounded at their left-hand sides 93, 95, respectively. The second and third capacitor plates have a width substantially the same as that of the top and bottom metal plates, and a length substantially the same as the first capacitor plate. Capacitor plates 31, 47 and 51 form a first capacitor group, and Capacitor plates 31, 48 and 51 form a second capacitor group. The two capacitor groups are connected in parallel. Each of the capacitor groups also consists two capacitors that connected, also in parallel (because both are grounded). The first capacitor group (31-47-51) consists of capacitor 31-47 and 51-47 connected in parallel, and the second capacitor group (31-48-51) consists of capacitor 31-48 and 51-48 also connected in parallel.

Figure 6F:
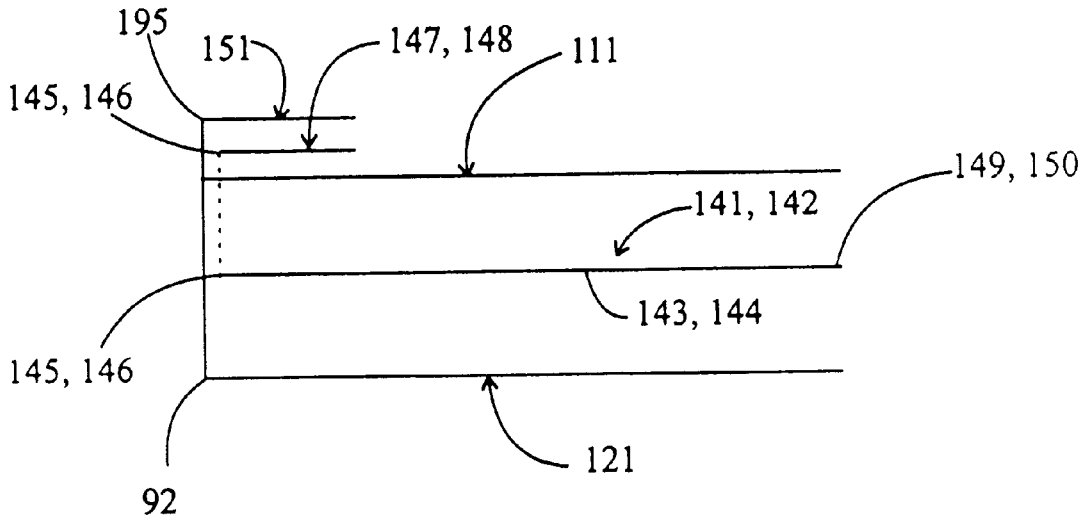
FIG. 6*f* is a schematic longitudinal cross-sectional view of the comb-line filter as shown in FIGS. 6*a–e*.
Figure 6A:
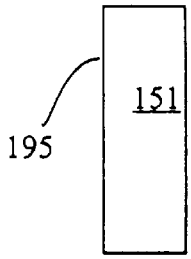
FIGS. 6*a–e* show the schematic top view of the top layer (top metal plate), first layer (second and third capacitor plates), second layer (first capacitor plate), third layer (resonator plates), and bottom layer (bottom metal plate), respectively, of the comb-line filter according to the second embodiment of the present invention.
Figure 6B:
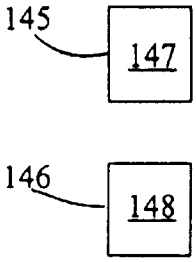
Figure 6C:
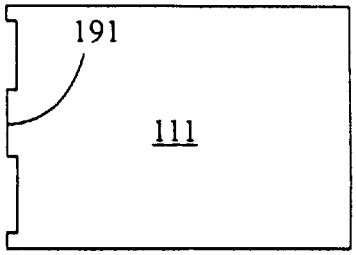
Figure 6D:
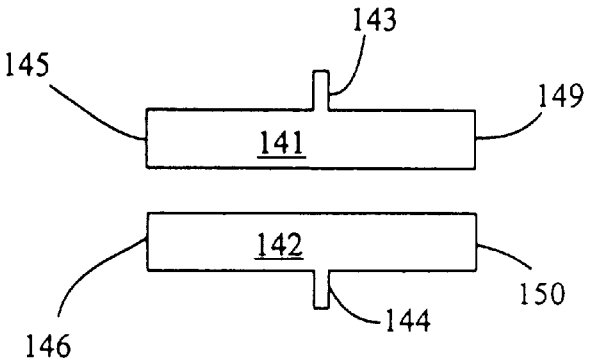
Figure 6E:
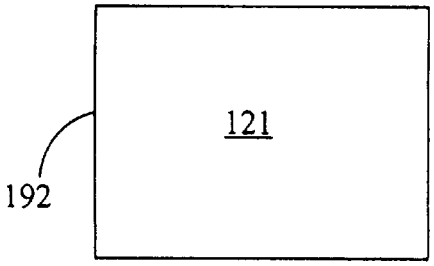

FIGS. 6*a–e* show the schematic top view of the top layer (top metal plate), first layer (second and third capacitor plates), second layer (first capacitor plate), third layer (resonator plates), and bottom layer (bottom metal plate), respectively, of the comb-line filter according to the second embodiment of the present invention. And FIG. 6*f* is a schematic cross-sectional view of the comb-line filter. The second embodiment of the present invention is a modified version of the first embodiment. As in the first embodiment, all the layers are in spaced apart relationship.

In the second embodiment, first and second folded portions 145, 146, of the resonator plates, 141, 142, respectively, are folded up vertically and penetrate through the first capacitor plate 111, which is a metal plate, without having contact therewith. The second and third capacitor plates 147, 148 are similarly placed above the two resonator plates, 141, 142, respectively, also in a spaced apart relationship. Unlike the first embodiment, wherein the second and third capacitor plates are stacked vertically, they are in the same plane but are in a spaced relationship. In this embodiment, the top metal plate and the second capacitor plate form a capacitor, which is connected in parallel with the capacitor formed by the second and first capacitor plates. This parallelly connected capacitor group (151-147-111) is similarly in a parallel relationship with an identical capacitor group involving the top metal plate, and the first and third capacitor plates (151-148-111). The folded portions 145 and 146 allow the resonators 141 and 142 to be connected with these two parallelly connected capacitor groups, 151-147-111 and 151-148-111, respectively. With the second embodiment, the entire comb-line filter can be made to have the same length as the resonator plates. The resonators 141 and 142 contain two small protrusions 143 and 144, which serve as input and output ports, respectively.

Figure 1A:
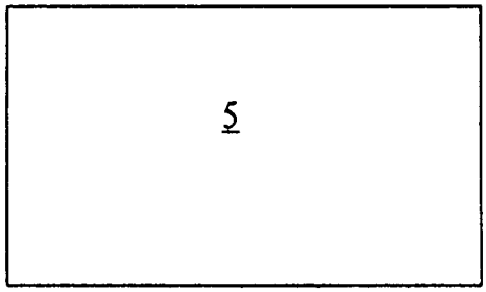
Fig. 1a (Prior Art)
FIG. 1*a* is a schematic top view of the top metal plate of the conventional planar comb-line filter.
Figure 1B:
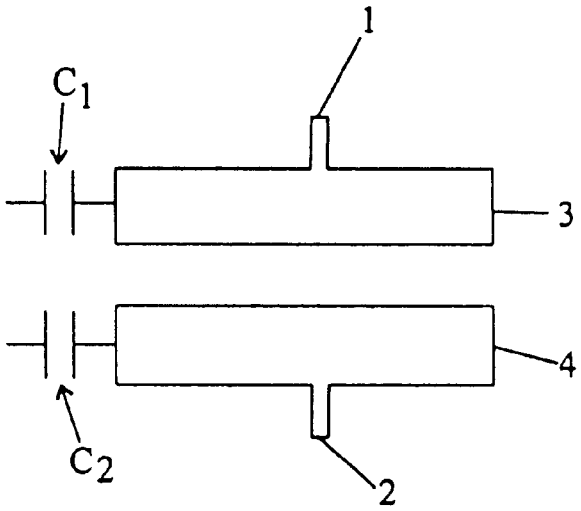
Fig. 1b (Prior Art)
FIG. 1*b* is a schematic top view of the first layer of the conventional planar comb-line filter as shown in FIG. 1*a*.
Figure 1C:
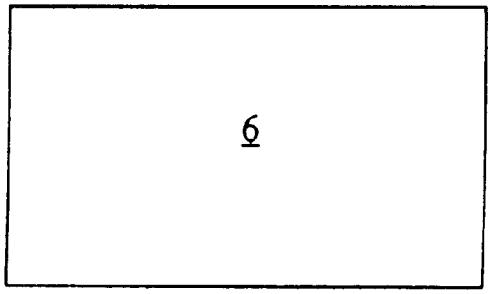
Fig. 1c (Prior Art)
FIG. 1*c* is a schematic top view of the bottom layer of the conventional planar comb-line filter as shown in FIG. 1*a*.
Figure 2:
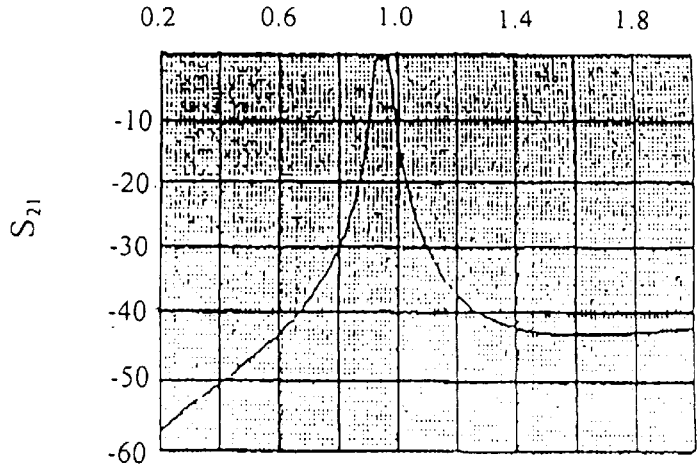
FIG. 2 is a plot of transmission coefficient, $S_{21}$ (dB), vs. frequency, F (GHz), for a planar comb-line under ideal conditions, wherein each capacitor has a capacity of 22.6 pF, the length of the resonators in the ideal planar comb-line filter (no coupling capacitance, or coupling capacitance less than 0.1 pF) has been reduced to 26.5° electrical length, and the passband has a central frequency of 947.5 MHz (or 0.9475 GHz).
Figure 3:
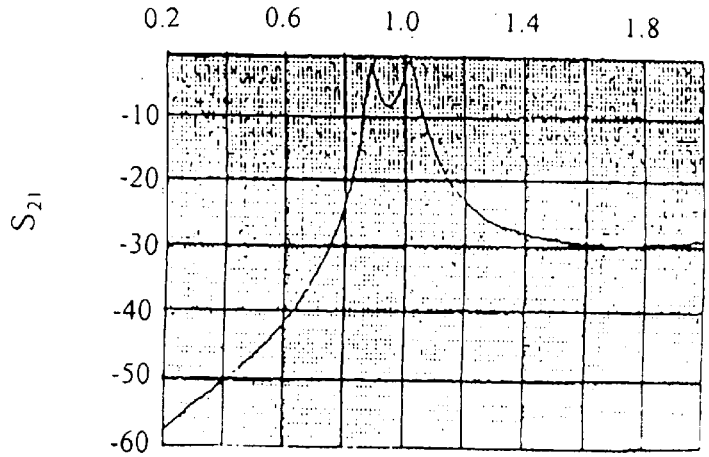
FIG. 3 is a simulated plot of transmission coefficient, $S_{21}$ (dB), vs. frequency, F (GHz), for a real life planar comb-line filters; the coupling capacity between the adjacent capacitors is determined to be 5.5 pF.
Figure 4:
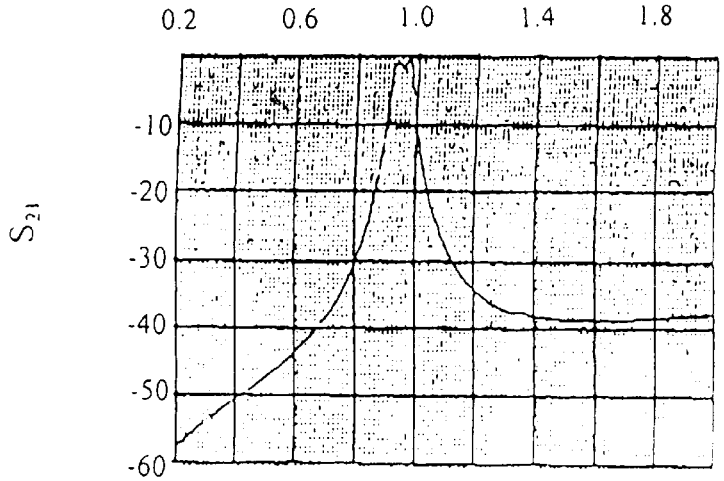
FIG. 4 is a simulated plot of transmission coefficient, $S_{21}$ (dB), vs. frequency, F (GHz), for another real life planar comb-line filters; the coupling capacity between the adjacent capacitors is determined to be 2.4 pF.
Figure 7:
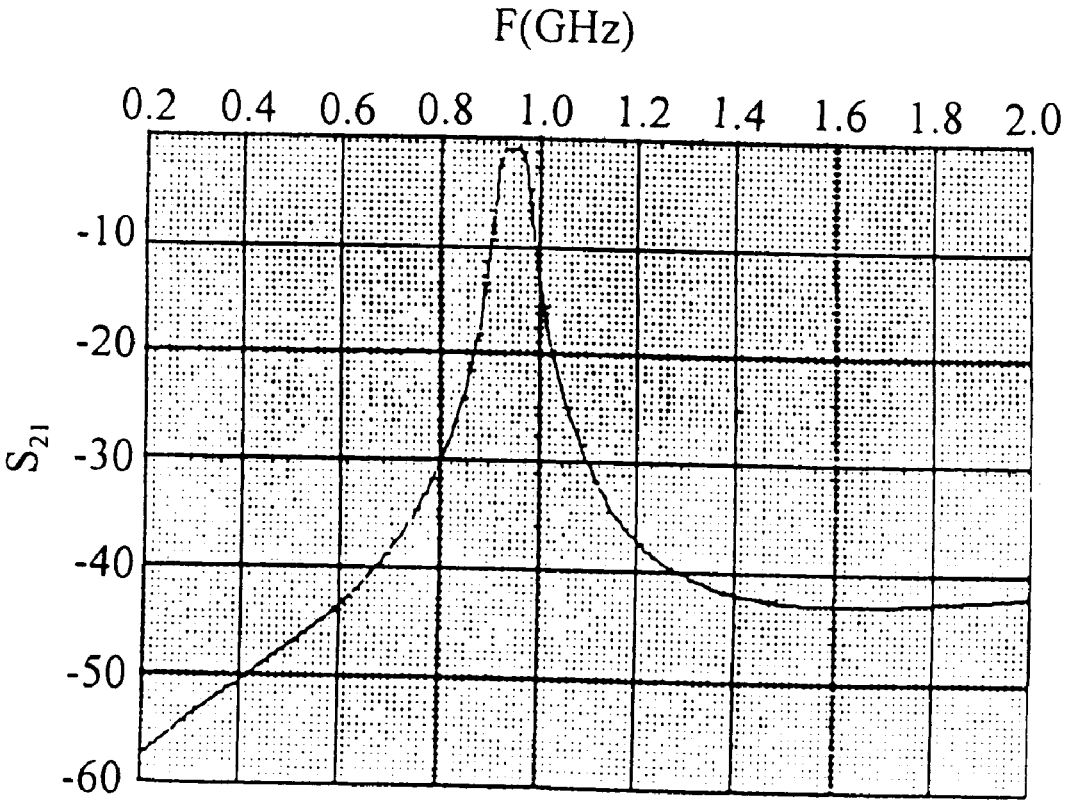
FIG. 7 is a simulated plot of transmission coefficient, $S_{21}$ (dB), vs. frequency, F (GHz), obtained from the first embodiment of the present invention.

FIG. 7 is a simulated plot of transmission coefficient, $S_{21}$ (dB) vs. frequency, F (GHz) obtained for the first embodiment as described above. Compared to FIGS. 3 and 4, which are the response curves of real life planar comb-line filters, the passband width is substantially reduced. But most importantly, the coupling capacity between the adjacent capacitors is reduced to essentially zero, $C_{12}$=0.01 pF. Compared to the ideal case as shown in FIG. 2, the insertion loss is a negligible 0.4 dB, and the passband width and attenuation in the stopband are almost identical to those observed from the ideal case.

Figure 8A:
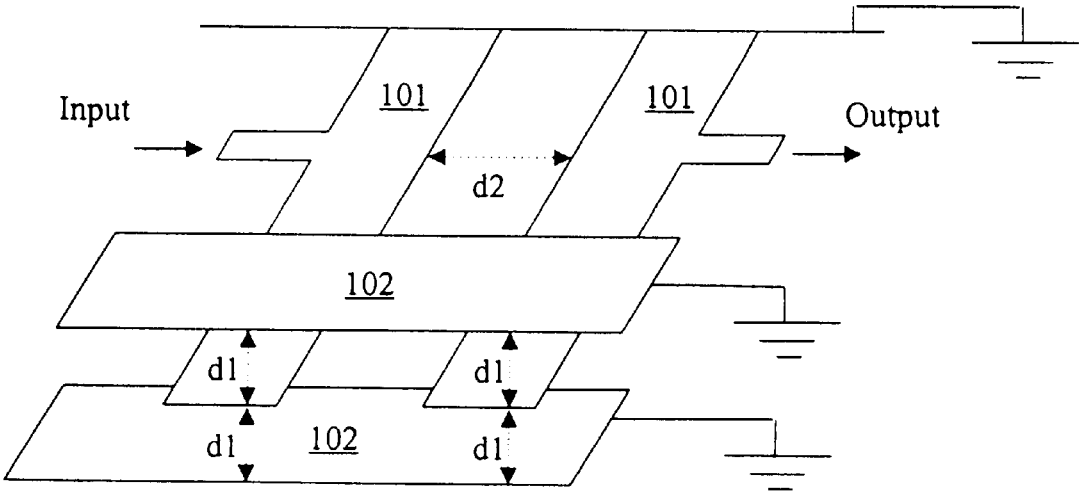
FIG. 8*a* is an illustrative perspective drawing showing the spatial relationship between the resonators and the capacitors which must meet a predetermined design criterion so as to minimize the coupling capacitance.
Figure 8B:
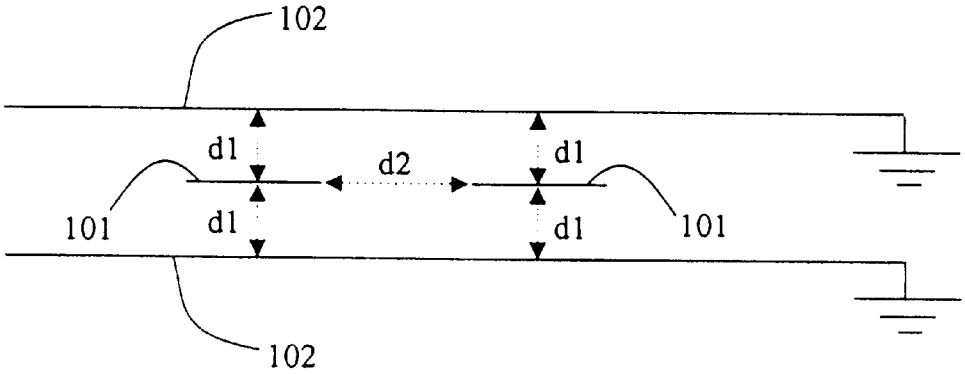
FIG. 8*b* is another illustrative drawing showing the spatial relationship between the resonators and the capacitors which must meet a predetermined design criterion so as to minimize the coupling capacitance.

FIGS. 8*a* and 8*b* are illustrative drawings showing the spatial relationship between the resonators 101 and the capacitors 102 which must meet a predetermined design criterion so as to minimize the coupling capacitance. As is was discussed above, the co-inventors of the present invention discovered that the main reason for the large coupling capacitance experienced in the conventional miniaturized comb-line filters is that, when the dimension of the comb-line filters is reduced, essentially everything was scaled down proportionally. The co-inventors of the present invention further discovered that, by maintaining the ratio between the separation between the two resonators (d2) and the separation between the resonator and the capacitor plate (d1) above about 3, the coupling capacitance can be reduced to 0.1 pF or lower. In a more preferred embodiment, the ratio of d1/d2 is maintained to below 10, and the coupling capacitance will be essentially zero (less than 0.01 pF).

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

EXAMPLE 1

A planar comb-line filter was constructed according to the configuration as shown in FIGS. 5*a*–5*e*, and 8*a*–8*b*. The capacitances between each pair of resonator and capacitor are the same at 11.25 pF. Because of the double-parallel relationship of the capacitors, the total capacitance is 11.25 pF×2×2=45.0 pF.

The comb-line filter in Example 1 was designed so that d2/d1 was 3.6 (d2=0.72 mm and d1=0.2 mm). The coupling capacitance C12 was calculated to be 0.08 pF. This is less than 0.1 pF.

EXAMPLE 2

The comb-line filter in Example 2 was identical to that in Example 1, except that it was designed so that d2/d1 was 9.0 (d2=0.72 mm and d1=0.08 mm). The coupling capacitance C12 was calculated to be 0.01 pF.

EXAMPLE 3

The comb-line filter in Example 3 was identical to that in Example 1, except that it was designed so that d2/d1 was 48.0 (d2=0.72 mm and d1=0.015 mm). The coupling capacitance C12 was calculated to be 0.0014 pF.

It should be noted that none of the prior art references taught or suggested a filter configuration that comprises the elements of the pair resonators, resonator extensions, and capacitor plates, as disclosed in the present invention. As it is illustrated in the above examples, by designing the planar comb-line filters having the ratio of separations between the resonators and between resonator and capacitors, a miniaturized (in the millimeters range) planar comb-line filter can be manufactured which exhibits an essentially zero coupling capacitance.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A planar comb-line filter comprising:

(a) a pair of resonators disposed in a planar and parallel relationship relative to each other, said pair of resonators being separated by a distance of d2;

(b) a pair of capacitor plates disposed above and below said pair of resonators, said pair of capacitor plates being in a parallel relationship relative to said pair of resonators and are separated by a distance d1, both below and above;

(c) a pair of resonator extensions extending from said pair of resonators, respectively;

(d) wherein said pair of capacitor plates and said pair of resonators are grounded, and said d2 and d1 have a ratio d2/d1 of at least 3.0.

2. The comb-line filter according to claim 1 which further comprises a pair of metal plates disposed above and below said pair of capacitor plates, respectively.

3. The comb-line filter according to claim 1 wherein said resonators have an electrical length less than 45°.

4. The comb-line filter according to claim 1 wherein said resonators have an electrical length no greater than 26.5°.

5. The comb-line filter according to claim 1 said ratio of d2/d1 is greater than about 9.0.

6. The comb-line filter according to claim 1 said ratio of d2/d1 is greater than about 50.0.

7. The comb-line filter according to claim 1 which has a capacitive coupling effective less than 0.1 pF.

8. The comb-line filter according to claim 1 which has a capacitive coupling effective no greater than 0.01 pF.

9. The comb-line filter according to claim 1 which further comprises an input terminal and an output terminal connected to said pair of resonator extensions, respectively.

* * * * *